US005778693A

United States Patent [19]

Mientus

[11] Patent Number: 5,778,693

[45] Date of Patent: Jul. 14, 1998

[54] AUTOMOTIVE HYDRAULIC ENGINE COOLING SYSTEM WITH THERMOSTATIC CONTROL BY HYDRAULIC ACTUATION

[75] Inventor: Michael J. Mientus, Dayton, Ohio

[73] Assignee: ITT Automotive Electrical Systems, Inc., Auburn Hills, Mich.

[21] Appl. No.: 770,832

[22] Filed: Dec. 20, 1996

[51] Int. Cl.[6] ..... F25D 17/00

[52] U.S. Cl. ..... 62/181; 123/41.12; 236/35

[58] Field of Search ..... 62/181; 236/35; 123/41.12

[56] References Cited

U.S. PATENT DOCUMENTS

| | | | |
|---|---|---|---|
| 3,641,879 | 2/1972 | Week et al. | 91/412 |
| 4,005,636 | 2/1977 | Dunn | 91/31 |
| 4,043,419 | 8/1977 | Larson et al. | 180/132 |
| 4,075,840 | 2/1978 | Jesswein | 60/422 |
| 4,130,990 | 12/1978 | Amedei et al. | 60/422 |
| 4,144,946 | 3/1979 | Melocik | 180/132 |
| 4,174,018 | 11/1979 | Liebert et al. | 180/132 |
| 4,179,888 | 12/1979 | Goscenski, Jr. | 60/420 |
| 4,189,919 | 2/1980 | Goscenski, Jr. | 60/420 |
| 4,223,646 | 9/1980 | Kinder | 123/41.12 |
| 4,410,058 | 10/1983 | Dymond | 180/143 |
| 4,414,809 | 11/1983 | Burris | 60/424 |
| 4,446,697 | 5/1984 | Goscenski, Jr. | 60/443 |
| 4,463,557 | 8/1984 | Miller et al. | 60/422 |
| 4,470,259 | 9/1984 | Miller et al. | 60/422 |
| 4,488,569 | 12/1984 | Rau | 137/101 |
| 4,570,849 | 2/1986 | Klaucke et al. | 236/35 |
| 4,625,751 | 12/1986 | Gage | 137/118 |
| 4,664,210 | 5/1987 | Yamaoka et al. | 180/132 |
| 4,738,330 | 4/1988 | Suzuki et al. | 180/141 |
| 4,941,437 | 7/1990 | Suzuki et al. | 123/41.12 |
| 4,966,066 | 10/1990 | Kauss et al. | 91/516 |
| 5,133,302 | 7/1992 | Yamada et al. | 123/41.12 |
| 5,293,952 | 3/1994 | Ledamoisel et al. | 180/132 |
| 5,315,829 | 5/1994 | Fischer | 123/41.12 |
| 5,531,190 | 7/1996 | Mork | 123/41.12 |
| 5,535,845 | 7/1996 | Buschur | 180/417 |
| 5,561,978 | 10/1996 | Buschur | 60/424 |

FOREIGN PATENT DOCUMENTS

| | | |
|---|---|---|
| 0042682 | 12/1981 | European Pat. Off. . |
| 7901084 | 12/1979 | WIPO . |

OTHER PUBLICATIONS

"Hydraulic Multiverbrauchersysteme", *Technisce Rundschau*, No. 13, Mar. 29, 1993.

*Primary Examiner*—William E. Topolcai
*Attorney, Agent, or Firm*—Thomas N. Twomey; J. Gordon Lewis

[57] ABSTRACT

An engine cooling system and method and apparatus for controlling hydraulic fluid flow between a plurality of hydraulic components in a hydraulic system is shown. The system and method utilized at least one hydraulic sensor for actuating a hydraulic valve which controls the fluid delivery to the hydraulic components. At least one of the hydraulic sensors includes a thermosensitive material which causes the sensor to deliver hydraulic pressure to an actuator on the valve when the material is heated in response to an increase in temperature of, for example, a coolant associated with the engine.

29 Claims, 1 Drawing Sheet

AUTOMOTIVE HYDRAULIC ENGINE COOLING SYSTEM WITH THERMOSTATIC CONTROL BY HYDRAULIC ACTUATION

BACKGROUND OF THE INVENTION

1. Field of the Invention

This invention relates to automotive hydraulic systems and has particular application to automotive hydraulic cooling systems having a power steering system and at least one other hydraulically powered device, including at least one hydraulic sensor for actuating a valve to control the flow supplied by a pump to the steering system and component.

2. Description of Related Art

Hydraulic fluid for a power steering unit is generally delivered by a constant flow rate pump. Flow continues at the prescribed volumetric rate, irrespective of system back pressure, so long as the pump is able to deliver it. That necessarily involves a risk of pump damage. Therefore, pumps for such systems generally are provided with pressure relief lines which terminate the pumping action in case of excessive system loads. This saves the pump at the expense of temporary impairment of power steering and temporary loss from any loss of service from anything else which may be powered by the hydraulic pump. Sometimes, bypass lines are provided around individual components of the system, so as to avoid loss of the entire system when a localized abnormality is experienced or to provide means for controlling flow between the components.

A cooling fan motor and cooling fan perform an essential function in protecting the automotive engine from over heating. However, the fan operation may be temporarily halted without serious risk to the motor vehicle or its passengers. It is not uncommon to find that a hydraulic motor is operated in series with a power steering unit, typically on a low priority basis.

In the past, electronically controlled valves were used to control an electrically-actuated valve to regulate fluid in response to pressure and/or temperature changes. In this regard, prior art valve devices typically include electronically controlled signals from a process monitoring engine coolant temperature or AC head pressure. If the pressure and/or temperature, respectively, were outside predetermined thresholds, then an electronic solenoid would actuate a valve in response to such conditions to control the hydraulic flow delivered to the power steering system or other hydraulic components.

Unfortunately, the use of electronics to sense or regulate the hydraulics increases the need for current as an energy source and also involves an energy conversion to accomplish its task. Thus, such systems can be inefficient in a hydraulic environment and also can unduly tax existing current sources and/or require larger current-providing components, such as larger alternators. This type of hydraulic environment may result in additional energy conversions which, in turn, can cause an unreliable product.

Therefore, there is need in an hydraulic environment to accomplish the same functions of sensing and regulating hydraulic flow rates to a plurality of hydraulic components (such as, for example, a hydraulic steering system and/or hydraulic fan motor).

SUMMARY OF THE INVENTION

It is the primary object of this invention to provide a sensing system and method comprising a sensing system for hydraulically sensing a pressure and/or temperature and controlling the flow to hydraulic components in response thereto.

It is another object of this invention to provide a hydraulic sensing system and method having a simplified design for hydraulically sensing a pressure change associated with an AC compressor and/or hydraulically sensing a temperature change relative to a coolant associated with the engine.

It is still another object of this invention to provide a system and method having a simplified design which controls hydraulic flow rate to one or a plurality of hydraulic components without the need for electrical sensors, solenoids and the like.

Still another object is to provide a hydraulic sensor capable of progressively actuating an actuator on a hydraulic valve, where the sensor comprises a piston having a temperature sensitive material having a coefficient of expansion which is proportional to the temperature to which the material is exposed, thereby causing the piston to pressurize an actuator on the hydraulic valve.

In one aspect, this invention comprises a thermostatic control for use on a vehicle comprising an engine having a hydraulic pump, a hydraulic cooling motor having a fan blade secured thereto and at least one hydraulic component, the thermostatic control comprising a hydraulically actuated valve coupled to the hydraulic pump for selectively controlling hydraulic fluid delivered to the hydraulic cooling motor and at least one hydraulic component in response to a hydraulically-sensed signal from either hydraulically-sensed pressure or hydraulically-sensed engine temperature.

In another aspect, this invention comprises an engine cooling system comprising a hydraulic pump, a first hydraulic component, a second hydraulic component coupled to the first hydraulic component, a hydraulically actuated valve coupled to the hydraulic pump, the second hydraulic steering system and the first hydraulic component and at least one hydraulic sensor coupled to the hydraulically actuated valve for hydraulically sensing either a temperature change associated with the engine or a air conditioning pressure change and for generating a hydraulic signal in response thereto, the hydraulically actuated valve altering the amount of hydraulic fluid delivered to at least one hydraulic component and the second hydraulic component when the bypass condition occurs.

In still another aspect, this invention comprises a method for thermostatically controlling cooling in a hydraulic cooling system associated with an engine of an automobile, the cooling system comprising a pump, a first hydraulic component and a second hydraulic component, the method comprising the steps of hydraulically sensing a bypass condition, the bypass condition corresponding to an increase in air conditioning pressure or increase in engine temperature, generating hydraulic signal in response to the bypass condition and controlling an amount of hydraulic fluid delivered to the first hydraulic component and the second hydraulic component in response to the hydraulic signal.

In yet another aspect, this invention comprises a thermostatic control for use on a vehicle comprising an engine having a hydraulic pump, a first hydraulic component and a second hydraulic component, the thermostatic control comprising a hydraulically actuated valve coupled to the hydraulic pump, the first hydraulic component and the second hydraulic component, a hydraulic sensor coupled to the hydraulically actuated valve for hydraulically sensing a bypass condition and selectively controlling hydraulic fluid delivered to the first and second hydraulic components in response thereto, the bypass condition corresponding to increase in either air conditioning pressure or engine temperature.

These and other objects and advantages of the invention will be apparent from the following description, the accompanying drawings and the appended claims.

DETAILED DESCRIPTION OF THE PREFERRED EMBODIMENTS

Figure 1:
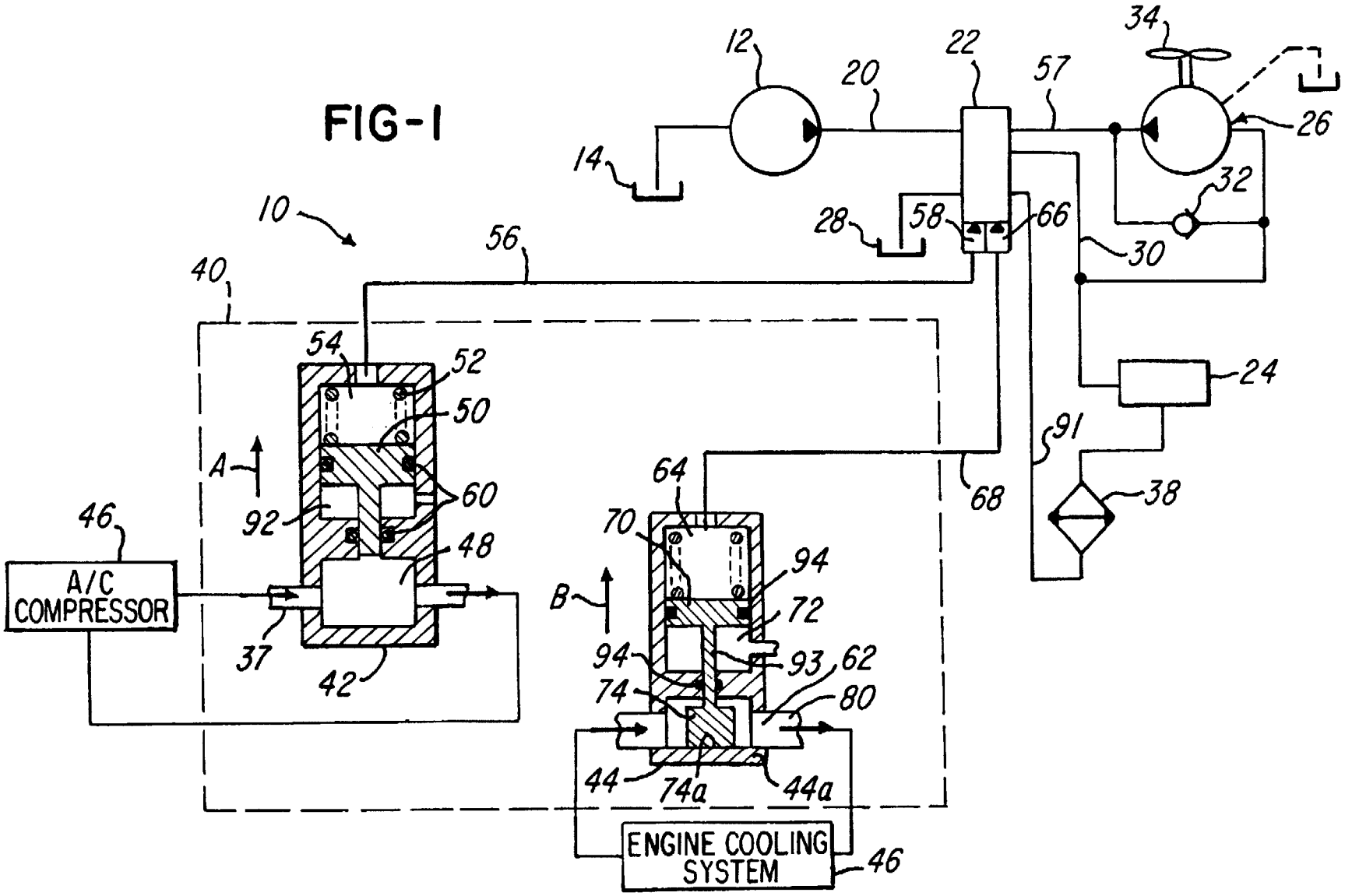
FIG. 1 is a schematic of a hydraulically controlled fluid supply system associated with a power steering system connected in series with an upstream cooling fan in accordance with one embodiment of the invention.

Referring now to FIG. 1, an engine cooling system 10 is shown comprising a hydraulic pump 12 for pumping hydraulic fluid (not shown) in the hydraulic system 10. The hydraulic pump 12 is powered by a shaft (not shown) which is coupled directly or via a pulley or other drive train (not shown) to an engine (not shown) of, for example, a vehicle. The pump 12 pumps hydraulic fluid (not shown) from a reservoir 14 into a supply line 20 into a pressure responsive valve 22 or means for controlling hydraulic flow to a plurality of hydraulic components, such as a hydraulic steering system 24 and hydraulic cooling motor 26.

The hydraulic valve 22 has an internal relief which drains flow to reservoir 28 as shown. Line 91 returns exhaust flow from the steering system 24 back to valve 22 which combines with excess pump flow and vents to reservoir 28. In the embodiment being described, the hydraulically actuated valve can be normally open or closed to line 30 depending on whether the system failure mode is to have the fan blade 34 fail in the off or on position, respectively. This permits a variable amount of hydraulic flow to be directed to hydraulic cooling motor 26, via line 57.

A check valve 32 which is situated across hydraulic cooling motor 26 is shown in order to prevent cavitation to negative gage pressure conditions from existing when the fan blade 34 is coasting down after system flow to the hydraulic motor has been bypassed to line 30. As illustrated, the hydraulic cooling motor 26 comprises a drive shaft 32 which rotatably drives a fan blade 34 for cooling the engine.

Line 30 is also coupled directly to an input end of the hydraulic steering system 24. It should be appreciated that the steering system 24 may comprise a power steering unit of the type shown and described in U.S. Pat. No. 5,535,845 which is assigned to the same Assignee as the present invention and which is incorporated herein by reference and made a part hereof. The steering system 24 discharges into an oil cooler 38 and then returns to hydraulically actuated valve 22 as shown.

The engine cooling system 10 further comprises sensing means or a sensing system 40 comprising at least one hydraulic sensor, such as either air conditioning pressure sensor 42 or coolant sensor 44. The air conditioning pressure sensor 42 is coupled directly in-line to a refrigerant line 37 of compressor 46. As refrigerant fluid accumulates in a chamber 48 of sensor 42 and the chamber pressure exceeds a predetermined value, such as 125 psi in the embodiment being described, it forces the piston 50 to work against a spring 52.

As piston 50 is moved in the direction of arrow A, hydraulic fluid (not shown) situated in chamber 54 pressurizes fluid line 56 to actuate a first actuator 58 on valve 22. Thus, as the pressure in line 56 increases to a predetermined value, actuator 58 is hydraulically actuated to cause valve 22 to direct a predetermined amount of flow to hydraulic cooling motor 26 via line 57.

In the embodiment being described, the predetermined amount of pressure is dictated by the resiliency of spring 52. Thus, if it is desired to have sensor 42 to have, for example, a higher set point, then a more resilient spring 52 may be situated in chamber 54.

Notice that the sensor 42 comprises a plurality of seals 60 for sealing chambers 48 and 50 to atmospheric chamber 92 and also for preventing mixing of refrigerant and hydraulic fluids.

Sensing means 40 further comprises the coolant sensor 44 which is coupled in-line with an engine cooling system 47 which comprises a radiator (not shown), radiator fluid (not shown), radiator reservoir and overfill reservoirs (not shown) and the like as is conventionally known. Similar to sensor 42, the coolant sensor 44 comprises a hydraulic fluid chamber 64 having hydraulic fluid (not shown) which is in fluid communication with an actuator 66 via line 68. The chamber 64 houses a piston 70 comprising a rod 72 with at least a portion thereof, such as portion 74, directly exposed to radiator fluid (not shown). It should be appreciated that the sensor 44 could be situated in the radiator of the engine cooling system 46. In the embodiment being described, the portion 74 comprises an end **74*a* which is secured directly to housing 44*a* of sensor 44. The portion 74 comprises a temperature-sensitive material which has a coefficient of expansion which is directly proportioned to the temperature so that, as temperature increases, the portion 74 expands to cause rod 72 to drive piston 70 to pressure hydraulic fluid situated in chamber 64 into line 68. This in turn, actuates actuator 66. Actuator 66, in turn, causes valve 22 to direct more fluid to hydraulic cooling motor 26 via line 68, thereby directing flow to hydraulic cooling motor 26 if the energy requirements for steering system 24** are not required.

Thus, as the coolant temperature in line 80 increases, the temperature sensitive material expands causing piston 70 to be driven in the direction of arrow B, thereby actuating actuator 66. In the embodiment being described, such actuation occurs when the coolant temperature is at least about 200 degrees fahrenheit.

Notice that sensor 44 comprises a plurality of seals 94 for sealing chambers 64 and 80 to atmospheric chamber 93 and also for preventing mixing of coolant and hydraulic fluids.

It should be appreciated that the air conditioning pressure sensor 42 and cooling sensor 44 logically operate in an "OR" manner, such that valve 22 is actuated to change the flow rates along lines 30 and 57 when either sensor 42 or 44 is actuated. Consequently, if air conditioning pressure increases, actuator 58 is actuated and valve 22 will open to line 57 to cause more flow to hydraulic cooling motor 26 to increase the speed of blade 34. Likewise, as sensor 44 senses an increase in coolant temperature, hydraulic pressure on line 68 actuates actuator 66 to increase the flow along line 57 to hydraulic cooling motor 26, thereby increasing the speed of fan blade 34. Also, the sensors 42 and 44 may act simultaneously to actuate valve 22 to increase flow along line 58, thereby increasing fan speed.

In the embodiment being described, valve 22 permits a variable amount of hydraulic fluid flow to hydraulic cooling motor 26, as mentioned earlier herein. Actuators 58 and 66, respectively, are responsive to pressure along lines 56 and 68 to cause valve 22 to vary to flow rate between lines 30 and 57 in direct proportion to the amount of pressure on lines 56 and 68. Thus, as air conditioning pressure sensor 42 hydraulically senses increased pressure or cooling temperature 44 hydraulically senses an increased temperature, the actuators 58 and 66 become hydraulically actuated. As hydraulic actuation by either actuator 58 or actuator 66 increases, the flow along line 58 increases proportionally, while the flow along line 30 decreases proportionally. Thus, it should be appreciated that the valve 22 and sensing system 40 provide means for selectively hydraulically varying the flow rate between a plurality of hydraulic components in response to hydraulic sensing from either sensors 42 and 44.

It should be appreciated that as the pump 12 flow rate increases, valve 22 causes all the flow to be directed to steering system 24 until it reaches a predetermined level in the embodiment described. As the speed of pump 12 increases, the amount of flow directed to hydraulic cooling motor 26 and steering system 24 increases proportionally. When one or both sensors 42 or 44 of sensing system 40 senses either a change of pressure or temperature, respectively, then actuators 58 and 60 may become progressively actuated in response thereto. In this regard, if the pressure in chamber 48 increases or the temperature of temperature sensitive material of portion 74 increases, the actuators 58 and 66, respectively, become progressively actuated in response thereto until one or both become fully actuated. As mentioned earlier herein, as the actuators 58 and 66 become progressively actuated, the amount of flow directed to hydraulic cooling motor 26 increases proportionally, while the amount of flow to steering system 24 remains unaffected.

In the embodiment being described, actuators 58 and 66 cause valve 22 to open in the same proportion, but they are not cumulative. However, it is contemplated that the actuators 58 and 66 could be provided such that, when they are actuated, the total flow directed to hydraulic cooling motor 26 increases in direct proportion to the cumulative actuation of actuators 58 and 66.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A thermostatic control for use on a vehicle comprising an engine having a hydraulic pump, a hydraulic cooling motor having a fan blade secured thereto and at least one hydraulic component; said thermostatic control comprising:

a hydraulically actuated valve coupled to said hydraulic pump for selectively controlling hydraulic fluid delivered to said hydraulic cooling motor and said at least one hydraulic component in response to a hydraulically-sensed signal from either hydraulically-sensed pressure or hydraulically-sensed engine temperature;

said hydraulically actuated valve comprising:

a bypass valve;

at least one refrigerant pressure sensor for hydraulically sensing a refrigerant pressure and for hydraulically actuating said bypass valve in response thereto;

wherein said at least one hydraulic pressure sensor comprises:

an air conditioning pressure sensor for hydraulically sensing an air conditioning refrigerant pressure and for generating a hydraulic signal in response thereto, said air conditioning pressure sensor actuating said bypass valve to cause said hydraulic component to be bypassed when said air conditioning refrigerant pressure exceeds a predetermined pressure.

2. The thermostatic control as recited in claim 1 wherein said at least one hydraulic pressure sensor further comprises:

a coolant temperature sensor for hydraulically sensing a coolant temperature and for generating a hydraulic signal in response thereto, said air conditioning refrigerant pressure sensor actuating said bypass valve to cause said hydraulic component to be bypassed when either said air conditioning refrigerant pressure or said coolant temperature exceed a predetermined air conditioning refrigerant pressure or a predetermined coolant temperature, respectively.

3. The thermostatic control as recited in claim 1 wherein said predetermined coolant temperature is at least 200 degrees Fahrenheit.

4. The thermostatic control as recited in claim 1 wherein said predetermined pressure is at least 125 psi.

5. A thermostatic control for use on a vehicle comprising an engine having a hydraulic pump, a hydraulic cooling motor having a fan blade secured thereto and at least one hydraulic component, said thermostatic control comprising:

a hydraulically actuated valve coupled to said hydraulic pump for selectively controlling hydraulic fluid delivered to said hydraulic cooling motor and said at least one hydraulic component in response to a hydraulically-sensed signal from either hydraulically-sensed pressure or hydraulically-sensed engine temperature;

wherein said at least one hydraulic pressure sensor comprises:

a coolant temperature sensor for hydraulically sensing a coolant temperature and for generating a hydraulic signal in response thereto, said coolant temperature sensor actuating said bypass valve to cause said hydraulic component to be bypassed when said coolant temperature exceeds a predetermined coolant temperature;

wherein said coolant temperature sensor comprises a temperature sensitive material which expands as the coolant temperature increases, thereby generating a hydraulic signal when said coolant temperature exceeds said predetermined coolant temperature.

6. The thermostatic control as recited in claim 5 wherein said predetermined coolant temperature is at least 200 degrees Fahrenheit.

7. A thermostatic control for use on a vehicle comprising an engine having a hydraulic pump, a hydraulic cooling motor having a fan blade secured thereto and at least one hydraulic component; said thermostatic control comprising:

a hydraulically actuated valve coupled to said hydraulic pump for selectively controlling hydraulic fluid delivered to said hydraulic cooling motor and said at least one hydraulic component in response to a hydraulically-sensed signal from either hydraulically-sensed pressure or hydraulically-sensed engine temperature;

wherein said hydraulically actuated valve comprises:

a bypass valve;

at least one refrigerant pressure sensor for hydraulically sensing a refrigerant pressure and for hydraulically actuating said bypass valve in response thereto;

wherein said at least one hydraulic pressure sensor comprises:

an air conditioning pressure sensor for hydraulically sensing an air conditioning refrigerant pressure and for generating a hydraulic signal in response thereto, said air conditioning pressure sensor actuating said bypass valve to cause said hydraulic component to be bypassed when said air conditioning refrigerant pressure exceeds a predetermined pressure;

wherein said at least one hydraulic pressure sensor further comprises:

a coolant temperature sensor for hydraulically sensing a coolant temperature and for generating a hydraulic signal in response thereto, said air conditioning refrigerant pressure sensor actuating said bypass valve to cause said hydraulic component to be bypassed when either said air conditioning refrigerant pressure or said coolant temperature exceed a predetermined air conditioning refrigerant pressure or a predetermined coolant temperature, respectively;

wherein said at least one hydraulic component is a fan motor.

8. An engine cooling system comprising:

a hydraulic pump;

a first hydraulic component;

a second hydraulic component coupled to said first hydraulic component;

a hydraulically actuated valve coupled to said hydraulic pump, said second hydraulic steering system and said first hydraulic component; and at least one hydraulic sensor coupled to said hydraulically actuated valve for hydraulically sensing either a temperature change associated with the engine or an air conditioning refrigerant pressure change and for generating a hydraulic signal in response thereto;

said hydraulically actuated valve altering the amount of hydraulic fluid delivered to said at least one hydraulic component and said second hydraulic component when said bypass condition occurs;

wherein said at least one hydraulic sensor comprises:

an air conditioning pressure sensor for hydraulically sensing an air conditioning refrigerant pressure and for generating a hydraulic signal in response thereto, said hydraulically actuated valve causing said second hydraulic component to be bypassed in response to said hydraulic signal;

wherein said at least one pressure sensor further comprises:

a coolant temperature sensor for hydraulically sensing a coolant temperature and for generating a second hydraulic signal in response thereto, said hydraulically actuated valve causing said second hydraulic component to be bypassed in response to either said first or second hydraulic signals.

9. The engine cooling system as recited in claim 8 wherein said coolant temperature sensor comprises a temperature sensitive material which expands when said coolant temperature exceeds a predetermined coolant temperature.

10. The engine cooling system as recited in claim 8 wherein said predetermined coolant temperature is at least 200 degrees Fahrenheit.

11. The engine cooling system as recited in claim 8 wherein said predetermined coolant temperature is at least 200 degrees Fahrenheit.

12. An engine cooling system comprising:

a hydraulic pump;

a first hydraulic component;

a second hydraulic component coupled to said first hydraulic component;

a hydraulically actuated valve coupled to said hydraulic pump, said second hydraulic steering system and said first hydraulic component; and at least one hydraulic sensor coupled to said hydraulically actuated valve for hydraulically sensing either a temperature chance associated with the engine or an air conditioning refrigerant pressure change and for generating a hydraulic signal in response thereto;

said hydraulically actuated valve altering the amount of hydraulic fluid delivered to said at least one hydraulic component and said second hydraulic component when said bypass condition occurs;

wherein said at least one hydraulic sensor comprises:

an air conditioning pressure sensor for hydraulically sensing an air conditioning refrigerant pressure and for generating a hydraulic signal in response thereto;

wherein said air conditioning pressure sensor is in fluid communication with said refrigerant, said sensor comprising a plurality of seals defining a sealing chamber to prevent said refrigerant from mixing with said hydraulic fluid.

13. An engine cooling system comprising:

a hydraulic pump;

a first hydraulic component;

a second hydraulic component coupled to said first hydraulic component;

a hydraulically actuated valve coupled to said hydraulic pump, said second hydraulic steering system and said first hydraulic component; and at least one hydraulic sensor coupled to said hydraulically actuated valve for hydraulically sensing either a temperature change associated with the engine or an air conditioning refrigerant pressure change and for generating a hydraulic signal in response thereto;

said hydraulically actuated valve altering the amount of hydraulic fluid delivered to said at least one hydraulic component and said second hydraulic component when said bypass condition occurs;

wherein said at least one hydraulic pressure sensor comprises:

a coolant temperature sensor for hydraulically sensing a coolant temperature and for generating a hydraulic signal in response thereto, said hydraulically actuated valve causing said second hydraulic component to be bypassed in response said hydraulic signal; and wherein said coolant temperature sensor comprises a plurality of seeds defining a sealing chamber for sealing said hydraulic fluid from said coolant.

14. A method for thermostatically controlling cooling in a hydraulic cooling system associated with an engine of an automobile, said cooling system comprising a pump, a first hydraulic component and a second hydraulic component; said method comprising the steps of:

hydraulically sensing a bypass condition;

said bypass condition corresponding to an increase in air conditioning refrigerant pressure or increase in engine temperature;

generating hydraulic signal in response to said by-pass condition; and controlling an amount of hydraulic fluid delivered to said first hydraulic component and said second hydraulic component in response to said hydraulic signal;

wherein said hydraulically sensing step further comprises the step of:

integrally forming a temperature sensitive material onto said coolant sensor, said temperature sensitive material expanding when said coolant temperature exceeds a predetermined coolant temperature.

15. The method as recited in claim 14 wherein said predetermined coolant temperature is at least 200 degrees Fahrenheit.

16. The method as recited in claim 14 wherein said first hydraulic component comprises a steering system.

17. The method as recited in claim 14 wherein said second hydraulic component comprises a hydraulic fan.

18. The method as recited in claim 16 wherein said second hydraulic component comprises a hydraulic fan.

19. The method and recited in claim 14 wherein said method further comprises the step of:

preventing said hydraulic fluid from mixing with non-hydraulic fluids during said hydraulically sensing step.

20. A method for thermostatically controlling cooling in a hydraulic cooling system associated with an engine of an automobile, said cooling system comprising a pump, a first hydraulic component and a second hydraulic component; said method comprising the steps of:

hydraulically sensing a bypass condition;

said bypass condition corresponding to an increase in air conditioning refrigerant pressure or increase in engine temperature;

generating hydraulic signal in response to said by pass condition; and controlling an amount of hydraulic fluid delivered to said first hydraulic component and said second hydraulic component in response to said hydraulic signal;

wherein said at least one pressure sensor further comprises:

bypassing said first hydraulic component when both an air conditioning pressure and a coolant temperature exceed a predetermined air conditioning pressure and a predetermined coolant temperature, respectively; and wherein said predetermined coolant temperature is at least 200 degrees Fahrenheit.

21. A thermostatic control for use on a vehicle comprising an engine having a hydraulic pump, a first hydraulic component and a second hydraulic component; said thermostatic control comprising:

a hydraulically actuated valve coupled to said hydraulic pump, said first hydraulic component and said second hydraulic component;

a hydraulic sensor coupled to said hydraulically actuated valve for hydraulically sensing a bypass condition and selectively controlling hydraulic fluid delivered to said first and second hydraulic components in response thereto, said bypass condition corresponding to increase in either air conditioning pressure or engine temperature;

wherein said hydraulic sensor comprises:

an air conditioning pressure sensor for hydraulically sensing an air conditioning pressure and for generating a hydraulic signal in response thereto;

wherein said hydraulic sensor comprises:

an air conditioning pressure sensor for hydraulically sensing an air conditioning pressure and for generating a hydraulic signal in response thereto, said air conditioning pressure sensor actuating said hydraulically actuated valve to cause said first hydraulic component to be bypassed when said air conditioning pressure exceeds a predetermined pressure.

22. The thermostatic control as recited in claim 21 wherein said hydraulic sensor comprises:

a coolant temperature sensor for hydraulically sensing a coolant temperature and for generating a hydraulic signal in response thereto, said coolant temperature sensor actuating said bypass valve to cause said first hydraulic component to be bypassed when said predetermined coolant temperature exceeds a predetermined level.

23. The thermostatic control as recited in claim 21 wherein said hydraulic sensor further comprises:

a coolant temperature sensor for hydraulically sensing a coolant temperature and for generating a hydraulic signal in response thereto, said coolant temperature sensor actuating said hydraulically actuated valve to cause said first hydraulic component to be bypassed when either said air conditioning pressure or said coolant temperature exceed either a predetermined air conditioning pressure or a predetermined coolant temperature, respectively.

24. A thermostatic control for use on a vehicle comprising an engine having a hydraulic pump, a first hydraulic component and a second hydraulic component; said thermostatic control comprising:

a hydraulically actuated valve coupled to said hydraulic pump, said first hydraulic component and said second hydraulic component;

a hydraulic sensor coupled to said hydraulically actuated valve for hydraulically sensing a by pass condition and selectively controlling hydraulic fluid delivered to said first and second hydraulic components i response thereto, said bypass condition corresponding to increase in either air conditioning pressure or engine temperature;

wherein said hydraulic sensor comprises:

an air conditioning pressure sensor for hydraulically sensing an air conditioning pressure and for generating a hydraulic signal in response thereto;

wherein said hydraulic sensor further comprises:

a coolant temperature sensor for hydraulically sensing a coolant temperature and for generating a hydraulic signal in response thereto, said coolant temperature sensor actuating said hydraulically actuated valve to cause said first hydraulic component to be bypassed when either said air conditioning pressure or said coolant temperature exceed either a predetermined air conditioning pressure or a predetermined coolant temperature, respectively;

wherein said coolant temperature sensor comprises a temperature sensitive material which expands as said a coolant temperature rises, thereby generating said hydraulic signal.

25. The thermostatic control as recited in claim 24 wherein said predetermined coolant temperature is at least 200 degrees Fahrenheit.

26. The thermostatic control as recited in claim 25 wherein said predetermined coolant temperature is at least 200 degrees Fahrenheit.

27. The thermostatic control as recited in claim 24 wherein said hydraulic sensor comprises:

at least one hydraulic pressure sensor for hydraulically sensing a hydraulic pressure and for hydraulically actuating said hydraulically actuated valve in response thereto;

wherein said predetermined pressure is at least 125 psi.

28. The thermostatic control as recited in claim 24 wherein said predetermined pressure is at least 125 psi.

29. The thermostatic control as recited in claim 24 wherein said first hydraulic component comprises a steering system and said second hydraulic component comprises a fan motor.

* * * * *